US005521560A

United States Patent [19]

Burns et al.

[11] Patent Number: 5,521,560

[45] Date of Patent: May 28, 1996

[54] MINIMUM PHASE SHIFT MICROWAVE ATTENUATOR

[75] Inventors: Richard W. Burns, Orange; Darren E. Atkinson, LaHabra, both of Calif.

[73] Assignee: Hughes Aircraft Company, Los Angeles, Calif.

[21] Appl. No.: 341,812

[22] Filed: Nov. 18, 1994

[51] Int. Cl.[6] ..... H01P 1/22

[52] U.S. Cl. ..... 333/81 A; 333/262

[58] Field of Search ..... 333/81 R, 81 A, 333/104, 262

[56] References Cited

U.S. PATENT DOCUMENTS

| | | | |
|---|---|---|---|
| 3,713,037 | 1/1973 | Hopfer | 333/81 A |
| 3,859,609 | 1/1975 | Couvillon et al. | 333/81 A |
| 3,921,106 | 11/1975 | Williams | 333/81 R |
| 4,019,160 | 4/1977 | Kam | 333/81 R |
| 4,097,827 | 6/1978 | Williams | 333/81 R |

FOREIGN PATENT DOCUMENTS

| | | | |
|---|---|---|---|
| 200809 | 9/1987 | Japan | 333/81 R |

*Primary Examiner*—Paul Gensler

*Attorney, Agent, or Firm*—Jeannette M. Walder; Wanda K. Denson-Low

[57] ABSTRACT

A minimum phase shift microwave attenuator circuit, providing very low insertion phase change with changing attenuation levels. Three PIN diodes are biased in parallel from a common node. The PIN diodes are held at zero or reverse bias for the "no attenuation" state, and are made slightly lossy to produce the attenuation state. In the attenuation state, the PIN diodes are utilized as current controlled lossy capacitors which change resistance with applied bias, but maintain constant capacitance, thereby providing low insertion phase deviation across wide attenuation levels.

29 Claims, 4 Drawing Sheets

FIG.6.
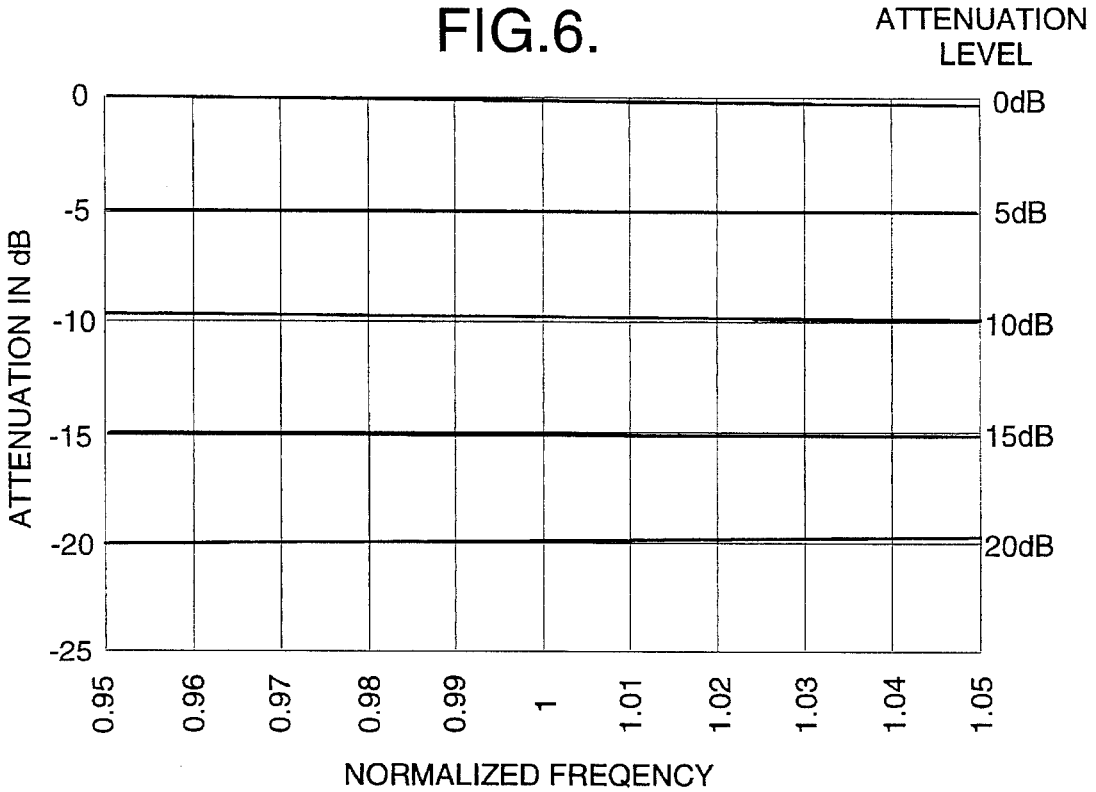
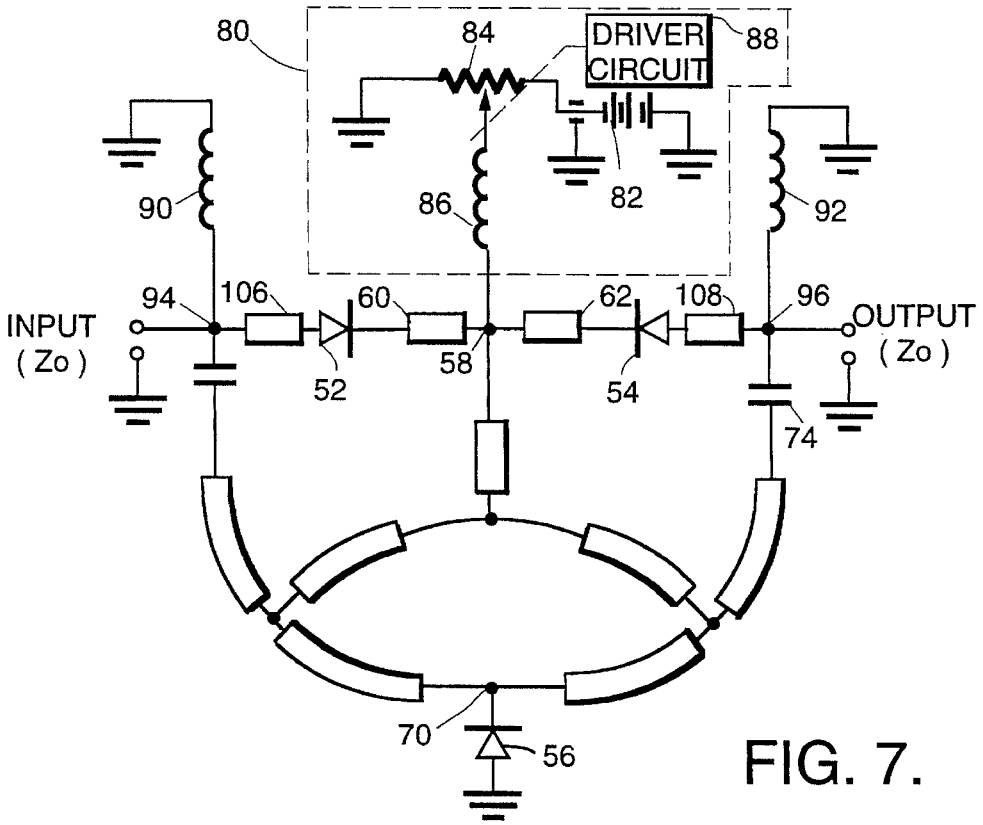
FIG. 7.

MINIMUM PHASE SHIFT MICROWAVE ATTENUATOR

TECHNICAL FIELD OF THE INVENTION

This invention relates to the field of microwave frequency attenuator circuits, and more particularly to a microwave attenuator with very low insertion phase shift change as the attenuation level is varied.

BACKGROUND OF THE INVENTION

Modern phased array radars typically use thousands of radiating elements. Behind these radiators are other microwave circuitry such as amplifiers, phase shifters, attenuators, low noise amplifiers (LNAs), RF switches, etc. The current trend is to integrate a number of these functions together into a common enclosure containing both transmit and receive circuitry. This technique allows for more accurate control of the amplitude and phase of the transmitted and received signal.

Various types of adjustable attenuators exist including microwave integrated circuit (MIC) types and monolithic microwave integrated circuit (MIMIC) types. These attenuators are either voltage or current controlled, and require some sort of bias control circuitry to obtain a desired attenuation level. These current or voltage controlled adjustable-type attenuators produce a variable insertion phase that varies with attenuation level due to the varying reactive effects of the control transistors or diodes used within the attenuator devices. This insertion phase is usually quite large and can be undesirable depending upon the application. In phased array radars, this effect can greatly degrade the performance of the antenna.

SUMMARY OF THE INVENTION

A low phase shift microwave variable attenuator device is described which provides a relatively constant insertion phase as the attenuation level is varied. The attenuator comprises first, second and third PIN diodes each having an anode and a cathode, the cathodes of each PIN diode coupled to a common node through electrically short transmission line segments. Two additional transmission line segments respectively couple the cathode of the third PIN diode to the anodes of the first and second PIN diodes. Bias supply circuitry is coupled to the common node for selectively forward biasing the PIN diodes into the conductive state. Means are provided for selectively turning off the forward bias so that zero bias is applied to the diodes.

The attenuator may be operated in a pass configuration when zero or reverse bias is applied to the PIN diodes, and in a variable attenuation state when the forward bias is applied to the diodes. The variable attenuation in this state is determined by the amount of forward bias applied to the PIN diodes. The forward bias is in the range from 0 to 0.5 volts, so that very low current is required to produce resistance changes for attenuation operation.

The bias supply circuitry includes bias return connections from the anodes of the first and second PIN diodes to ground through respective first and second RF chokes.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 4, 5 and 6 show the results of simulation of the attenuator circuit of FIG. 1. FIG. 4 is a plot of the calculated attenuation performance as a function of normalized frequency. FIG. 5 is a plot of the relative insertion phase for several attenuation levels for the variable attenuator as a function of frequency. FIG. 6 is a plot of the return loss for the variable attenuator as a function of normalized frequency.

FIG. 7 is a simplified schematic diagram showing a particular embodiment of the attenuator circuit, fabricated in microstrip line.

DETAILED DESCRIPTION OF THE PREFERRED EMBODIMENT

Figure 1:
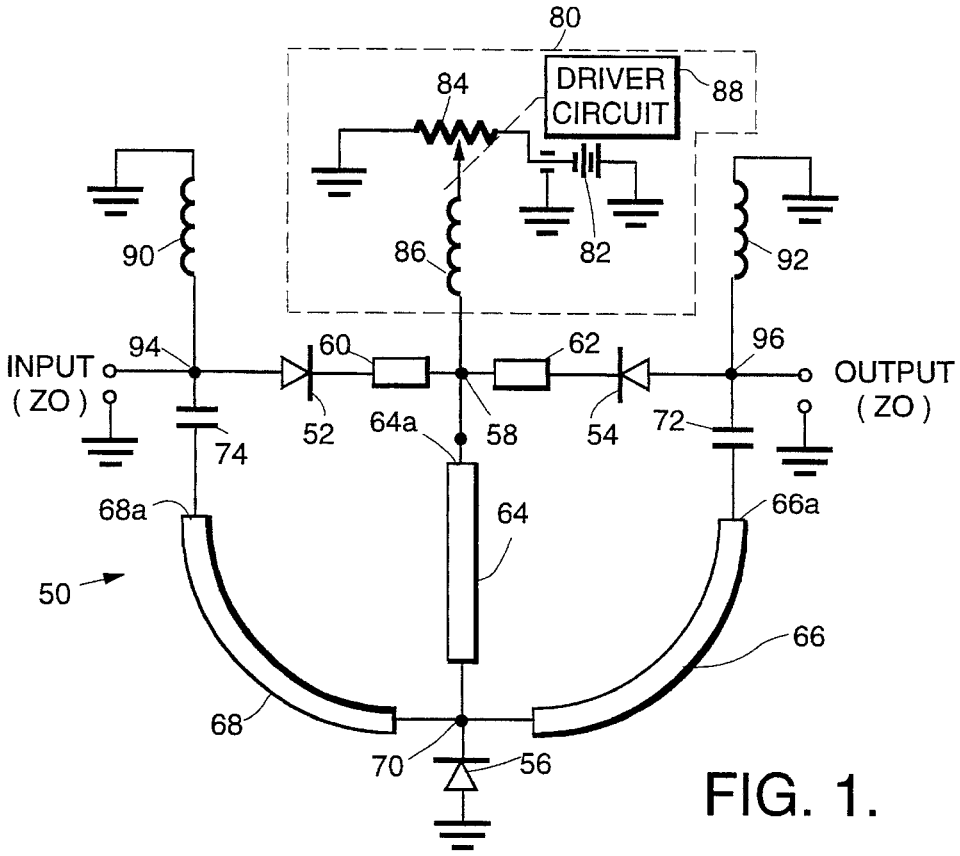
FIG. 1 is a schematic diagram of a low phase shift microwave attenuator in accordance with the invention.

A minimum phase shift microwave attenuator 50 in accordance with the invention is shown in FIG. 1. A unique feature of this attenuator is that it provides very low insertion phase change with changing attenuation levels. Also, this embodiment employs heavily doped "P" type, "I" intrinsic region, heavily doped "N" type (PIN) diodes 52, 54 and 56 forward biased between 0 and approximately 0.5 volts in the attenuation state, so that very low current is required to produce resistance changes for attenuator operation.

The attenuator 50 comprises three PIN diodes 52, 54, 56 biased in parallel from a common node 58. The diodes 52 and 54 are connected in series between the attenuator device input and output ports, with the third diode 56 connected in shunt from the common node 70 to ground. The input to the attenuator 50 is taken between the anode of diode 52 at node 94 and ground. The output to the attenuator is taken between the anode of diode 54 at node 96 and ground. Three transmission line sections 64, 66 and 68 are connected at a common node 70 with the cathode of shunt connected PIN diode 56, the anode of PIN diode 56 being connected to ground. Ends 68A and 66A of the transmission lines 68 and 66 are separately connected at nodes 94 and 96 to the respective anodes of PIN diodes 52 and 54 through dc blocking capacitors 74 and 72. The cathodes of the diodes 52 and 54 are respectively connected to node 58 through electrically short, series transmission line sections 60 and 62, respectively. The end 64A of transmission line 64 is also connected to node 58.

Any type of transmission line structure may be used to fabricate the transmission lines of the circuit, e.g., strip line, fin line, coplanar line, and microstrip line. Microstrip line is the presently preferred type due to its ease of implementation.

A bias supply is included for selectively biasing the PIN diodes 52, 54 and 56 comprising the attenuator 50, and comprises a variable voltage source 80 connected to the common node 58. The variable voltage source 80 in an exemplary implementation comprises a battery 82 whose positive terminal is connected to ground and whose negative terminal is connected to the common node 58 through a voltage divider circuit 84 and an RF choke 86. Bias return is provided through RF chokes 90 and 92 which connect nodes 94 and 96, the anodes of PIN diodes 52 and 54, to ground. The variable voltage source further includes in this embodiment a driver circuit 88 which controls the voltage divider circuit 84 to control the voltage level of the source 82. Thus, it may be seen that the PIN diodes 52, 54 and 56 can be biased to the conductive state by application of a sufficient negative potential to the cathodes of the diodes.

The circuit operation is effected by adjusting the bias of the three PIN diodes 52, 54, 56 simultaneously, forming variable resistors at three key points within the circuit. This is achieved through the variable voltage bias supply 80 and bias return circuitry.

Figure 2:
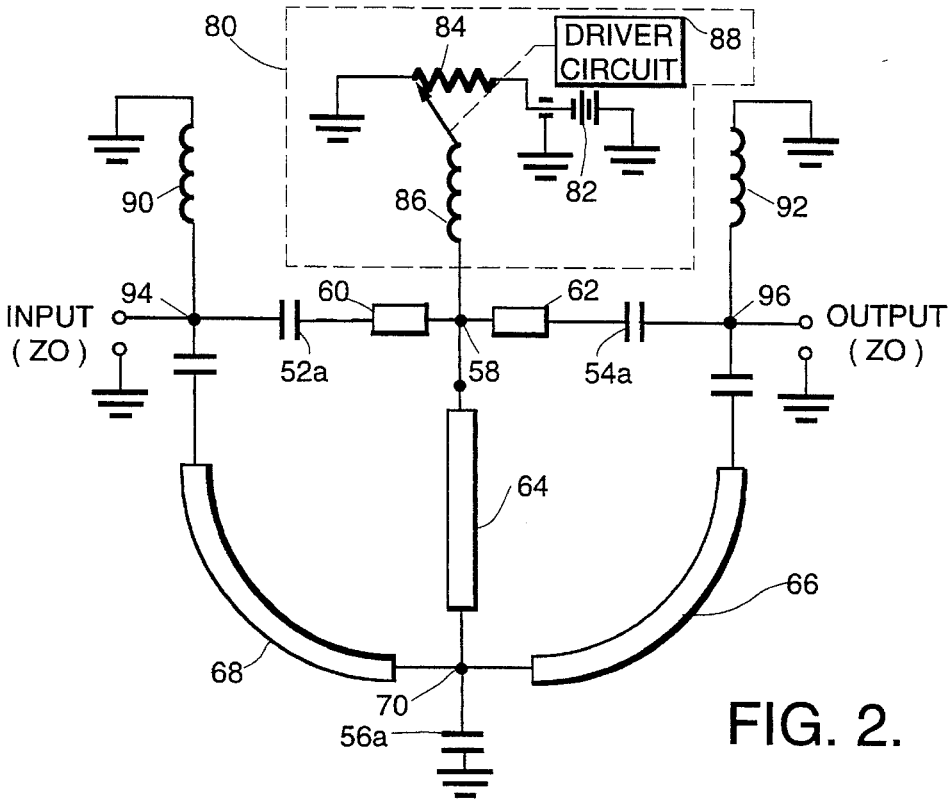
FIG. 2 is an equivalent circuit of the attenuator of FIG. 1 in the low loss, no attenuation state.
Figure 3:
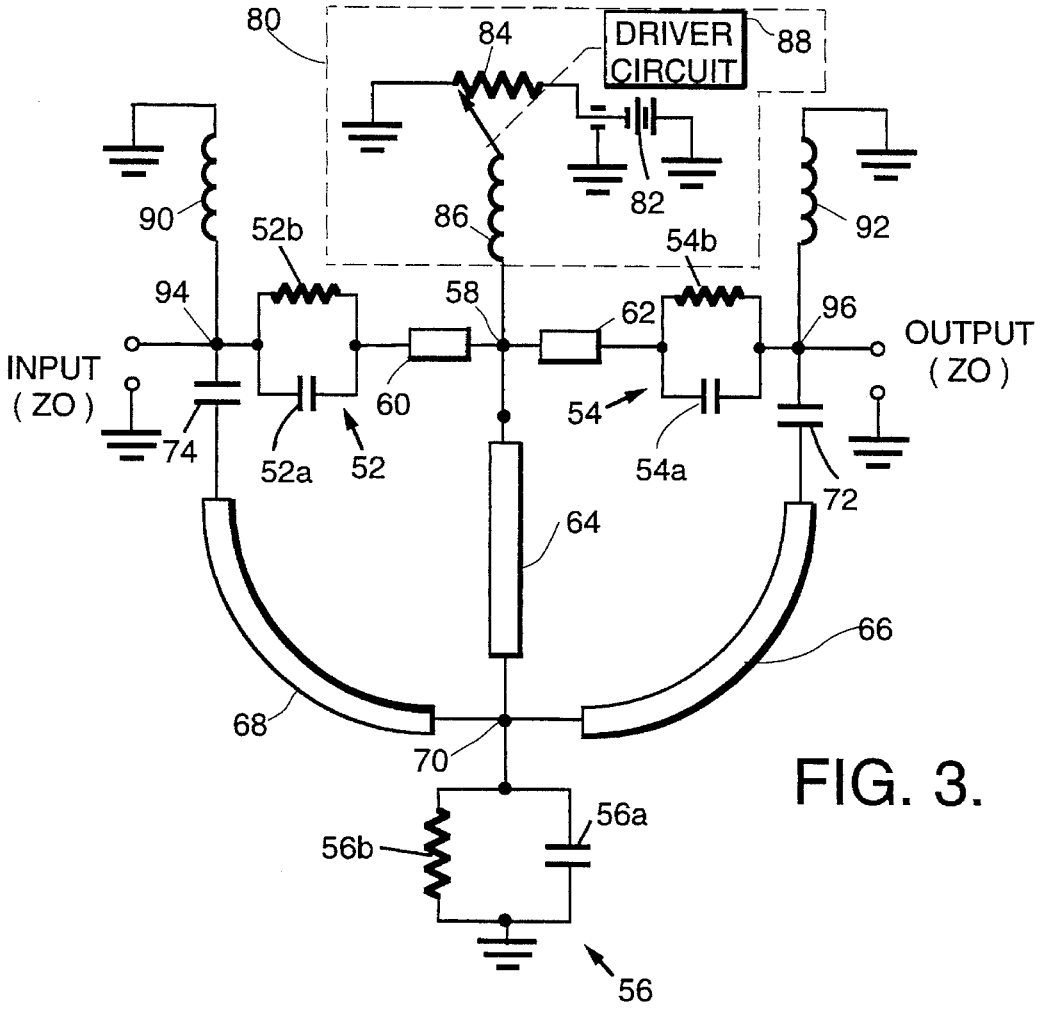
FIG. 3 is an equivalent circuit of the attenuator of FIG. 1 in a state for providing various attenuation levels.

FIGS. 2 and 3 show two equivalent circuits for the attenuator. The three PIN diodes are held at zero bias for the pass (no attenuation) state, and are made slightly lossy to produce the attenuation state. In this embodiment, the PIN diodes 52, 54 and 56 are utilized as current controlled lossy capacitors shown as 52A, 54A and 56A which change resistance, shown as variable resistors 52B, 54B and 56B, with applied bias but maintain constant capacitance, thereby providing for low insertion phase deviation across wide attenuation levels.

FIG. 2 illustrates the low loss, pass (no attenuation) state with the PIN diodes 52, 54 and 56 biased at zero bias, i.e., with the voltage divider circuit 84 controlled to essentially connect node 58 to ground. In this state, the PIN diodes are nonconductive, presenting a very low loss capacitive reactance. Thus, the PIN diodes present the constant capacitance, determining the very low attenuation of the attenuator circuit 50. To obtain even lower insertion loss of the device, the diodes can be reverse biased, e.g., with a positive voltage applied to node 58. Exemplary reverse bias voltages for PIN diodes are typically in the range of 1–50 volts.

FIG. 3 shows the circuit configuration for obtaining various attenuation levels. Here the voltage divider circuit 84 is controlled by the driver circuit 88 to apply some negative bias to node 58 and to the PIN diodes 52, 54 and 56, which are then biased as lossy capacitors consisting of junction capacitance 52A, 54A and 56A, and variable resistors 52B, 54B and 56B, with variable resistance 52B, 54B and 56B across the diodes' capacitive junctions giving different attenuation levels. The voltage level across the PIN diodes affects the attenuation level of the circuit 50 by changing the intrinsic region resistance of the PIN diodes. This lossy capacitor state of the PIN diode is obtained by slightly biasing the PIN diode in the forward direction between 0 and approximately 0.5 volts. The lengths of the transmission lines 60–68 within the circuit 50 are chosen to compensate for the constant capacitive junctions of the diodes 52, 54 and 56, which contribute to maintaining the insertion phase of the circuit very low as the various attenuation levels are obtained.

While a voltage divider circuit 84 is illustrated as a means for putting the attenuator circuit in the pass state, other arrangements can alternatively be employed. For example, a switch could be used to connect the variable voltage source to the common node. Or the bias circuit could be controlled to reverse bias the PIN diodes to the nonconductive state. Alternatively, the bias circuit could be controlled to bias the PIN diodes strongly to the conductive state to put the device in the pass state, although this may not provide as high a dynamic range as can be obtained for attenuators employing reverse diode biasing to obtain the pass state. In this case, typically the forward bias voltage will exceed 0.5 V to provide the current needed to lower the series resistance of the diode to a very low level.

The attenuator circuit 50 is designed as double a pi circuit. Line length and impedance values are chosen so that the inductive susceptance of the shunt transmission lines 64, 66 and 68 resonates or compensates the electrical effects of the capacitance of the series PIN diodes 52 and 54, producing a matched filter structure. The electrical length and impedance of the transmission lines are then numerically optimized using circuit analysis software to obtain desirable impedance match and attenuation performance over a given frequency band. One exemplary circuit analysis program suitable for the purpose is the Touchstone Circuit Analysis program, EESOF Inc. 31194 La Baya Drive, Westlake Village, Calif. 91362.

Instead of PIN diodes, NIP diodes, i.e., heavily doped "N" type, "I" intrinsic region, heavily doped "P" type, can equivalently be used. The diode polarities and bias polarity are reversed from the PIN diode implementation.

Figure 4:
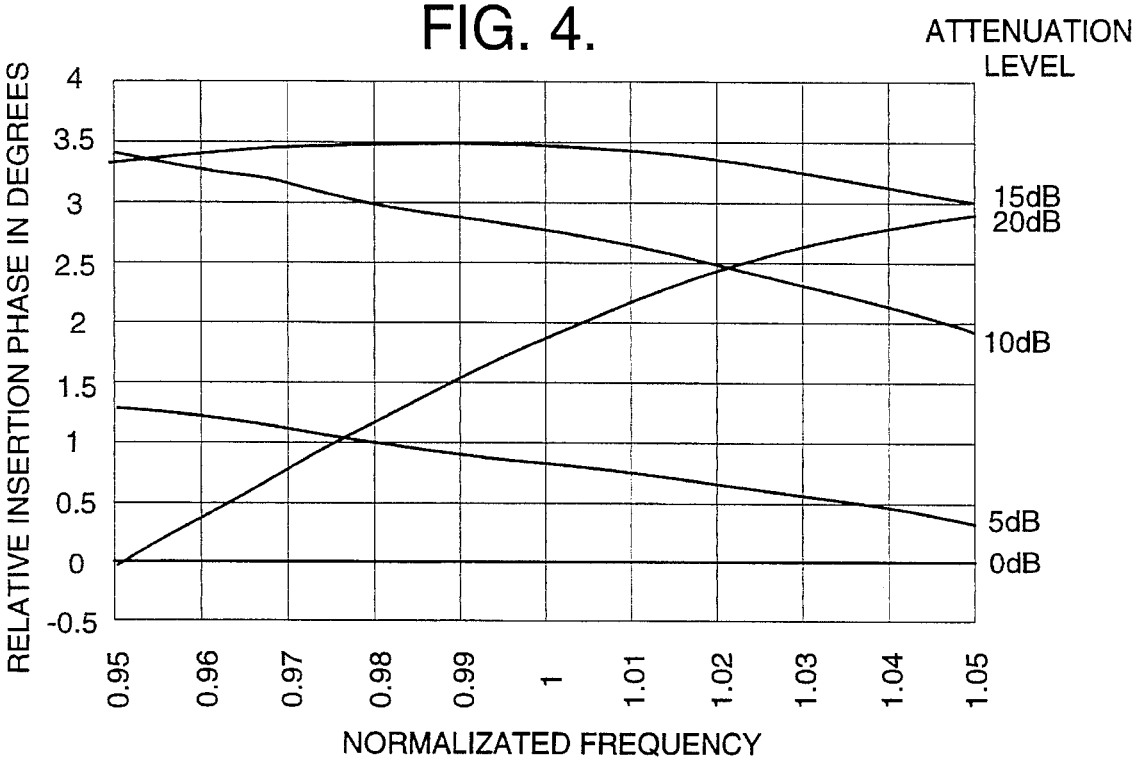
Figure 5:
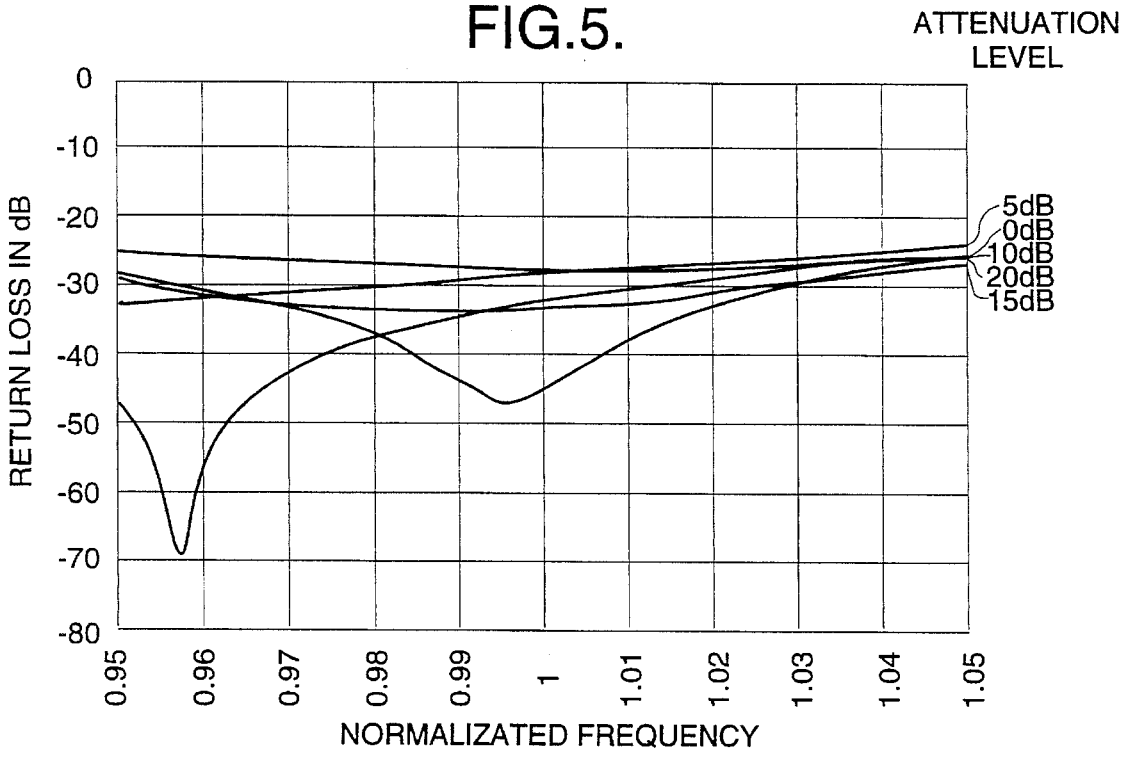

A 20 dB attenuator in accordance with the invention was simulated with a circuit analysis software, the Touchstone Circuit Analysis program. For the simulation, transmission lines 60 and 62 had respective electrical lengths of 25 degrees and characteristic impedances of 37 ohms, transmission line 64 had an electrical length of 122 degrees and characteristic impedance of 45 ohms, and lines 66 and 68 had respective electrical lengths of 98 degrees and characteristic impedance of 44 ohms. The attenuation level was varied between 0 and 20 dB in 5 dB steps as shown in FIG. 4. The insertion phase varied to a maximum of about +3.5 degrees across the frequency band as the attenuation was varied from 0 to 20 dB, as shown in FIG. 5. The simulated device was impedance matched to a 50 ohm system better than about 23 dB for all attenuation levels as shown in FIG. 6.

FIG. 7 is a circuit schematic of an alternative embodiment of a variable attenuator in accordance with the invention, suited for fabrication in microstrip line.

The device has wide application in phased array radar systems where electronically controlled attenuation is necessary for reducing amplitude errors inherent to microwave amplifiers. The device also protects LNAs in hybrid amplifier/phase shifter modules by using the attenuator as a high isolation component between the LNA and limiter circuits in the receive path. Also, the attenuator could also be used to electronically adjust the antenna amplitude distribution on receive. The invention can be used to improve performance and to lower costs for both airborne and ground based radar systems.

The purpose of this device is to provide arbitrary attenuation with very low insertion phase shift. The advantage of this device over conventional variable attenuators is the very low insertion phase change over the attenuation range. Also, the attenuation level can be selected in an analog or digital manner, i.e., the attenuation level of the device can be set to an infinite number of levels between its minimum and maximum attenuation range. This feature allows the attenuator to be used with an analog driver circuit as well as a digital driver circuit that has a discrete number of attenuation levels available for use. In this latter configuration, the driver voltages necessary to produce the finite number of equal attenuation steps must be determined and stored in the driver circuit for retrieval when a given attenuation level is required.

In other, known attenuators at X-band frequencies, insertion phase changes of 50 degrees for attenuation adjustments of 15 dB are not uncommon. If these attenuators are used in a phased array radar antenna for amplitude control, the varying phase characteristic will increase phase errors across the array. This increased phase error increases the antennas sidelobe levels, thus degrading the antennas performance.

The effect can be reduced by phase shifter corrections stored in electronic memory such as EEPROMs or in the beam steering unit, but this increases cost and complexity of the system since phase corrections need to be stored for many attenuation level settings. This invention with its inherent low insertion phase versus attenuation will eliminate performance degradation of the antenna and the expensive circuitry needed for phase error reduction required by the prior art.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A low relative phase shift microwave variable attenuator device, comprising:

first, second and third diodes each having an anode and a cathode, each diode having heavily doped regions sandwiching an intrinsic region;

first, second and third transmission line segments respectively coupling either all said cathodes or all said anodes of said first, second and third diodes to a common node, and wherein an input to said attenuator is taken at the cathode of said first diode and an output is taken at the cathode of said second diode, in the case when the anodes are all coupled to the common node, and wherein an input is taken at the anode of said first diode and an output is taken at the anode of said second diode when the cathodes are all coupled to the common node;

bias supply circuitry for applying a variable, selective bias voltage to said diodes to forward bias said first, second and third diodes in the conductive state;

wherein said attenuator may be operated in a variable attenuation state, said variable attenuation determined by the forward bias voltage applied to said diodes.

2. The attenuator of claim 1 wherein said bias supply circuitry further comprises means for applying zero bias to said diodes to operate said attenuator in a low attenuation, pass configuration.

3. The attenuator of claim 2 wherein said means for applying zero bias comprises a voltage divider circuit and a voltage source.

4. The attenuator of claim 1 wherein said bias circuitry for selectively forward biasing said diodes comprises means for applying bias voltages in the magnitude range between zero and approximately 0.5 volts to said diodes.

5. The attenuator of claim 1 wherein said bias circuitry comprises a variable voltage source coupled to said common node through an RF choke.

6. The attenuator of claim 1 wherein said diodes are PIN diodes.

7. The attenuator of claim 6 wherein said cathodes of said PIN diodes are connected to said common node.

8. The attenuator of claim 7 wherein said bias supply circuitry further comprises bias return connections from said anodes of said first and second PIN diodes to ground through respective first and second RF chokes.

9. The attenuator of claim 7 further comprising fourth and fifth transmission line segments respectively coupling the cathode of said third diode to the anodes of said first and second diodes.

10. The attenuator of claim 9 wherein said first, second, third, fourth and fifth transmission line segments provide compensation for capacitive PIN junctions comprising said diodes.

11. The attenuator of claim 9 wherein said transmission lines are microstrip transmission lines.

12. The attenuator of claim 4 wherein said bias circuitry comprises a variable voltage source and a driver circuit for controlling said voltage source to provide said bias voltage range.

13. The attenuator of claim 1 further comprising means for biasing said diodes to a low loss state at microwave frequencies, so that said attenuator presents low attenuation.

14. A low relative phase shift microwave variable attenuator device, comprising:

first, second and third PIN diodes each having an anode and a cathode, the cathodes of said PIN diodes coupled to a common node, and wherein an input to said attenuator is taken at said anode of said first PIN diode, and an output is taken at said anode of said second PIN diode;

first and second transmission line segments respectively coupling the cathode of said third PIN diode to the anodes of said first and second PIN diodes;

variable bias supply circuitry coupled to said common node for selectively forward biasing said PIN diodes in the conductive state;

means for selectively operating said bias supply circuitry so that said attenuator may be operated in a low attenuation pass configuration, or in a variable attenuation state, said variable attenuation determined by the bias applied to said PIN diodes.

15. The attenuator of claim 14 wherein said bias circuitry for selectively forward biasing said PIN diodes comprises means for applying bias voltages in the magnitude range between zero and approximately 0.5 volts to said PIN diodes.

16. The attenuator of claim 14 wherein said means for selectively operating said bias supply circuitry comprises a variable voltage divider circuit.

17. The attenuator of claim 14 wherein said bias circuitry comprises a variable voltage source coupled to said common node through an RF choke.

18. The attenuator of claim 14 wherein said bias supply circuitry further comprises bias return connections from said anodes of said first and second PIN diodes to ground through respective first and second RF chokes.

19. The attenuator of claim 14 further comprising a third transmission line segment connecting said first diode cathode to said common node, a fourth transmission line segment connecting said second diode cathode to said common node, a fifth transmission line segment connecting said third diode cathode to said common node, and wherein said first, second, third, fourth and fifth transmission line segments provide compensation for capacitive PIN junctions comprising said diodes.

20. The attenuator of claim 14 wherein said transmission lines are microstrip transmission lines.

21. The attenuator of claim 15 wherein said bias circuitry comprises a variable voltage source and a driver circuit for controlling said voltage source to provide said bias voltage range.

22. A microwave variable attenuator device, comprising:

first, second and third PIN diodes each having an anode and a cathode, the cathodes of said PIN diodes coupled to a common node;

first and second transmission line segments respectively coupling the cathode of said third PIN diode to the anodes of said first and second PIN diodes;

grounding means for connecting said anode of said third PIN diode to ground, and wherein an input to said attenuator is taken at said anode of said first PIN diode and an output is taken at said anode of said second PIN diode;

bias supply circuitry coupled to said common node for selectively forward biasing said PIN diodes in the conductive state, said circuitry including a variable voltage source for applying a variable negative potential to said common node;

means for selectively controlling said bias supply circuitry so that said attenuator may be operated in a pass configuration when zero bias is applied to said PIN diodes, and said attenuator may be operated in a variable attenuation state when said bias circuitry is operated to forward bias said diodes, said variable attenuation determined by the bias applied to said PIN diodes.

23. The attenuator of claim 22 wherein said bias circuitry for selectively forward biasing said PIN diodes comprises means for applying bias voltages in the range between zero and 0.5 volts to said PIN diodes.

24. The attenuator of claim 22 wherein said means for controlling said bias supply circuitry comprises a voltage divider circuit.

25. The attenuator of claim 22 wherein said voltage source is coupled to said common node through an RF choke.

26. The attenuator of claim 22 wherein said bias supply circuitry further comprises bias return connections from said anodes of said first and second PIN diodes to ground through respective first and second RF chokes.

27. The attenuator of claim 22 further comprising a third transmission line segment connecting said first diode cathode to said common node, a fourth transmission line segment connecting said second diode cathode to said common node, a fifth transmission line segment connecting said third diode cathode to said common node, and wherein said first, second, third, fourth and fifth transmission line segments provide compensation for capacitive PIN junctions comprising said diodes.

28. The attenuator of claim 22 wherein said transmission lines are microstrip transmission lines.

29. The attenuator of claim 22 wherein said bias circuitry comprises a driver circuit for controlling said voltage source to provide a bias voltage range.

* * * * *